US010619857B2

(12) United States Patent
Lemoine et al.

(10) Patent No.: US 10,619,857 B2
(45) Date of Patent: Apr. 14, 2020

(54) COOLING CONFIGURATION FOR COMBUSTOR ATTACHMENT FEATURE

(71) Applicant: UNITED TECHNOLOGIES CORPORATION, Farmington, CT (US)

(72) Inventors: Jonathan Lemoine, Vernon, CT (US); Steven D. Porter, Wethersfield, CT (US); Kevin Zacchera, Glastonbury, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 119 days.

(21) Appl. No.: 15/699,838

(22) Filed: Sep. 8, 2017

(65) Prior Publication Data

US 2019/0078789 A1 Mar. 14, 2019

(51) Int. Cl.

| | |
|---|---|
| ***F23R 3/60*** | (2006.01) |
| ***F23R 3/00*** | (2006.01) |
| ***F23M 5/04*** | (2006.01) |

(52) U.S. Cl.

CPC ..... *F23R 3/60* (2013.01); *F23M 5/04* (2013.01); *F23R 3/002* (2013.01); *F23R 2900/03041* (2013.01)

(58) Field of Classification Search

CPC .... F23R 3/60; F23R 3/002; F23R 2900/0304; F23R 2900/03041; F23M 5/04; F02K 1/82; F02K 1/822; F01B 35/041

See application file for complete search history.

(56) References Cited

U.S. PATENT DOCUMENTS 4,422,300 A * 12/1983 Dierberger ..... F23R 3/007 60/753
4,423,000 A 12/1983 Dierberger
(Continued)

FOREIGN PATENT DOCUMENTS

CN 202418176 9/2012
EP 1389690 2/2004
(Continued)

OTHER PUBLICATIONS

European Patent Office, European Search Report dated Nov. 20, 2018 in Application No. 18192784.9.
(Continued)

*Primary Examiner* — Steven M Sutherland
*Assistant Examiner* — Rodolphe Andre Chabreyrie
(74) *Attorney, Agent, or Firm* — Snell & Wilmer L.L.P.

(57) ABSTRACT

A combustor panel may include an attachment feature having a central longitudinal axis and extending from a cold side of the combustor panel. The attachment feature may include a tip portion and a base portion and the attachment feature may be configured to extend through a combustor shell such that the tip portion is disposed outward of a diffuser-facing side of the combustor shell. The base portion may be configured to be disposed between the cold side of the combustor panel and the diffuser-facing side of the combustor shell. The attachment feature may define a core passage extending from an inlet opening defined on the tip portion and extending partially through the attachment feature to terminate within the attachment feature. The attachment feature may also define an offshoot passage extending from the core passage to an outlet opening defined on the base portion.

16 Claims, 6 Drawing Sheets

(56) References Cited

U.S. PATENT DOCUMENTS

| | | | | |
|---|---|---|---|---|
| 4,749,298 | A | 6/1988 | Bundt et al. | |
| 4,820,097 | A | 4/1989 | Maeda et al. | |
| 5,019,079 | A | 5/1991 | Ross | |
| 6,718,774 | B2 | 4/2004 | Razzell | |
| 9,518,737 | B2 | 12/2016 | Pidcock et al. | |
| 9,644,843 | B2 | 5/2017 | Herborth | |
| 10,151,486 | B2 | 12/2018 | Sandoval | |
| 10,247,419 | B2 | 4/2019 | Slavens | |
| 2003/0123953 | A1 | 7/2003 | Razzell | |
| 2004/0093872 | A1* | 5/2004 | Tiemann | F16B 33/00 60/796 |
| 2007/0280822 | A1 | 12/2007 | Frost | |
| 2008/0115506 | A1 | 5/2008 | Patel et al. | |
| 2010/0263386 | A1 | 10/2010 | Edwards | |
| 2011/0011095 | A1 | 1/2011 | Ladd et al. | |
| 2013/0117996 | A1 | 5/2013 | Ducornait et al. | |
| 2014/0096527 | A1 | 4/2014 | Bangerter | |
| 2014/0130501 | A1 | 5/2014 | Cunha | |
| 2014/0190166 | A1* | 7/2014 | Pidcock | F23R 3/002 60/722 |
| 2015/0096302 | A1* | 4/2015 | Herborth | F23R 3/002 60/752 |
| 2015/0128602 | A1 | 5/2015 | Clemen | |
| 2015/0135719 | A1* | 5/2015 | Gerendas | F23R 3/002 60/752 |
| 2015/0260400 | A1 | 9/2015 | Clemen | |
| 2015/0285496 | A1* | 10/2015 | Grendel | F23M 5/04 60/753 |
| 2015/0345789 | A1 | 12/2015 | Papple et al. | |
| 2016/0265772 | A1 | 9/2016 | Eastwood | |
| 2016/0265775 | A1 | 9/2016 | Cunha | |
| 2016/0273770 | A1* | 9/2016 | Hanson | F23R 3/06 |
| 2016/0313004 | A1 | 10/2016 | Chang | |
| 2016/0313005 | A1 | 10/2016 | Chang | |
| 2017/0205069 | A1 | 7/2017 | Tentorio | |
| 2018/0283691 | A1* | 10/2018 | Corsmeier | F02C 7/32 |
| 2018/0292089 | A1 | 10/2018 | Porter | |

FOREIGN PATENT DOCUMENTS

| | | |
|---|---|---|
| EP | 2743585 | 6/2014 |
| EP | 3009744 | 4/2016 |
| EP | 3086041 | 10/2016 |
| GB | 2356041 | 5/2001 |
| WO | 2015017180 | 2/2015 |
| WO | 2015069466 | 5/2015 |
| WO | 2015302892 | 5/2015 |

OTHER PUBLICATIONS

European Patent Office, European Search Report dated Dec. 3, 2018 in Application No. 18192778.1.

Tracy A. Propheter-Hinckley et al., U.S. Appl. No. 15/698,967, filed Sep. 8, 2017 entitled "Cooling Configurations for Combustor Attachment Features".

Tracy A. Propheter-Hinckley et al., U.S. Appl. No. 15/699,163, filed Sep. 8, 2017 entitled "Cooling Configurations for Combustor Attachment Features".

Bellows et al., U.S. Appl. No. 15/699,514, filed Sep. 8, 2017 entitled "Cooling Configurations for Combustor Attachment Features".

Tracy A. Propheter-Hinckley et al., U.S. Appl. No. 15/699,648, filed Sep. 8, 2017 entitled "Cooling Configurations for Combustor Attachment Features".

European Patent Office, European Search Report dated Feb. 13, 2019 in Application No. 18192574.4.

European Patent Office, European Search Report dated Feb. 7, 2019 in Application No. 18192830.0.

European Patent Office, European Search Report dated Feb. 13, 2019 in Application No. 18192789.8.

European Patent Office, European Search Report dated May 8, 2019 in Application No. 18192830.0.

USPTO, Restriction/Election Requirement dated Jun. 10, 2019 in U.S. Appl. No. 15/698,967.

USPTO, Restriction/Election Requirement dated Jun. 10, 2019 in U.S. Appl. No. 15/699,163.

USPTO, Restriction/Election Requirement dated Jun. 10, 2019 in U.S. Appl. No. 15/699,514.

USPTO, Restriction/Election Requirement dated Jun. 10, 2019 in U.S. Appl. No. 15/699,648.

USPTO, Non-Final Rejection dated Sep. 4, 2019 in U.S. Appl. No. 15/699,514.

USPTO, Non-Final Rejection dated Sep. 3, 2019 in U.S. Appl. No. 15/698,967.

USPTO, Non-Final Rejection dated Sep. 3, 2019 in U.S. Appl. No. 15/699,163.

USPTO, Non-Final Office Action dated Oct. 3, 2019 in U.S. Appl. No. 15/699,648.

* cited by examiner

COOLING CONFIGURATION FOR COMBUSTOR ATTACHMENT FEATURE

FIELD

The present disclosure relates to combustors, and more specifically, to providing cooling air to and around combustor attachment features.

BACKGROUND

A gas turbine engine typically includes a fan section, a compressor section, a combustor section, and a turbine section. A fan section may drive air along a bypass flowpath while a compressor section may drive air along a core flowpath. In general, during operation, air is pressurized in the compressor section and is mixed with fuel and burned in the combustor section to generate hot combustion gases. The hot combustion gases flow through the turbine section, which extracts energy from the hot combustion gases to power the compressor section and other gas turbine engine loads. The compressor section typically includes low pressure and high pressure compressors, and the turbine section includes low pressure and high pressure turbines.

Combustors used in gas turbine engines generally rely on combustor panels, attached to a combustor shell, to interface with hot combustion gases and guide the combustion gases into the turbine. Combustor panel attachment features are generally utilized to couple the combustor panels to the combustor shell. However, conventional combustors often have reduced cooling airflow in the vicinity of the combustor panel attachment features, and thus such areas in the combustor may be susceptible to structural damage and/or oxidation caused by the high temperature of the combustion gases.

SUMMARY

In various embodiments, the present disclosure provides a combustor panel having an attachment feature having a central longitudinal axis and extending from a cold side of the combustor panel. The attachment feature includes a tip portion and a base portion, according to various embodiments. The attachment feature may be configured to extend through a combustor shell such that the tip portion is disposed outward of a diffuser-facing side of the combustor shell. The base portion is configured to be disposed between the cold side of the combustor panel and the diffuser-facing side of the combustor shell, according to various embodiments. In various embodiments, the attachment feature defines a core passage and an offshoot passage. The core passage may extend from an inlet opening defined on the tip portion and may extend partially through the attachment feature to terminate within the attachment feature. In various embodiments, the offshoot passage extends from the core passage to an outlet opening defined on the base portion.

In various embodiments, the attachment feature is integrally formed with the combustor panel. In various embodiments, the core passage extends parallel to the central longitudinal axis. In various embodiments, the core passage is coaxial with the central longitudinal axis. In various embodiments, the offshoot passage is one offshoot passage of a plurality of offshoot passages. The plurality of offshoot passages may be circumferentially distributed about and may extend radially from, relative to the central longitudinal axis of the attachment feature, the core passage. The plurality of offshoot passages may include 3 or 4 offshoot passages, according to various embodiments. In various embodiments, an angle between the central longitudinal axis and each offshoot passage of the plurality of offshoot passages is between about 15 degrees and about 85 degrees. In various embodiments, the angle is between about 30 degrees and about 60 degrees. In various embodiments, the angle is about 45 degrees.

Also disclosed herein, according to various embodiments, is a gas turbine engine. The gas turbine engine may include a combustor shell having a diffuser-facing side and a combustor-facing side. The gas turbine engine may also include a combustor panel comprising a cold side and a hot side. The combustor panel may be coupled to the combustor shell via an attachment feature integrally formed with and extending from the cold side of the combustor panel. The attachment feature may have a central longitudinal axis and the attachment feature may extend through a hole in the combustor shell. An annular cooling cavity is defined between the combustor shell and the combustor panel, according to various embodiments. A cooling airflow conduit may extend through the attachment feature and may include an inlet opening for receiving cooling air from a diffuser chamber that is at least partially defined by the diffuser-facing side of the combustor shell and an outlet opening for delivering the cooling air to the annular cooling cavity adjacent the attachment feature.

In various embodiments, a tip portion of the attachment feature is disposed outward of the hole in the combustor shell and a base portion of the attachment feature is disposed between the cold side of the combustor panel and the diffuser-facing side of the combustor shell. In various embodiments, the cooling airflow conduit includes a core passage and an offshoot passage. The core passage may extend from the inlet opening defined on the tip portion and may extend partially through the attachment feature to terminate within the attachment feature. The offshoot passage may extend from the core passage to the outlet opening defined on the base portion.

In various embodiments, the tip portion of the attachment feature includes a threaded circumference for engaging a nut, wherein a washer is disposed between the nut and the diffuser-facing side of the combustor shell. In various embodiments, the outlet opening of the offshoot passage is disposed inward of the washer. In various embodiments, the outlet opening of the offshoot passage is at least partially disposed within the hole in the combustor shell. In various embodiments, the hole in the combustor shell includes a chamfered inward edge or a filleted inward edge. In various embodiments, the combustor panel includes a plurality of standoffs extending from the cold side of the combustor panel and circumferentially disposed around the base portion of the attachment feature. In such embodiments, the outlet opening of the offshoot passage may be configured to deliver impingement cooling air to an interconnected volume defined between the standoffs and the attachment feature.

Also disclosed herein, according to various embodiments, is a method of manufacturing a combustor panel. The method may include forming an attachment feature extending from a cold side of the combustor panel, forming a core passage extending from a tip portion of the attachment feature, partially through a length of the attachment feature, and terminating within the attachment feature, and forming an offshoot passage extending from the core passage to an outlet opening defined on a base portion of the attachment feature. In various embodiments, forming the core passage and forming the offshoot passage are performed via at least one of electrical discharge machining, additive manufacturing, or core casting.

The forgoing features and elements may be combined in various combinations without exclusivity, unless expressly indicated herein otherwise. These features and elements as well as the operation of the disclosed embodiments will become more apparent in light of the following description and accompanying drawings.

Figure 1:
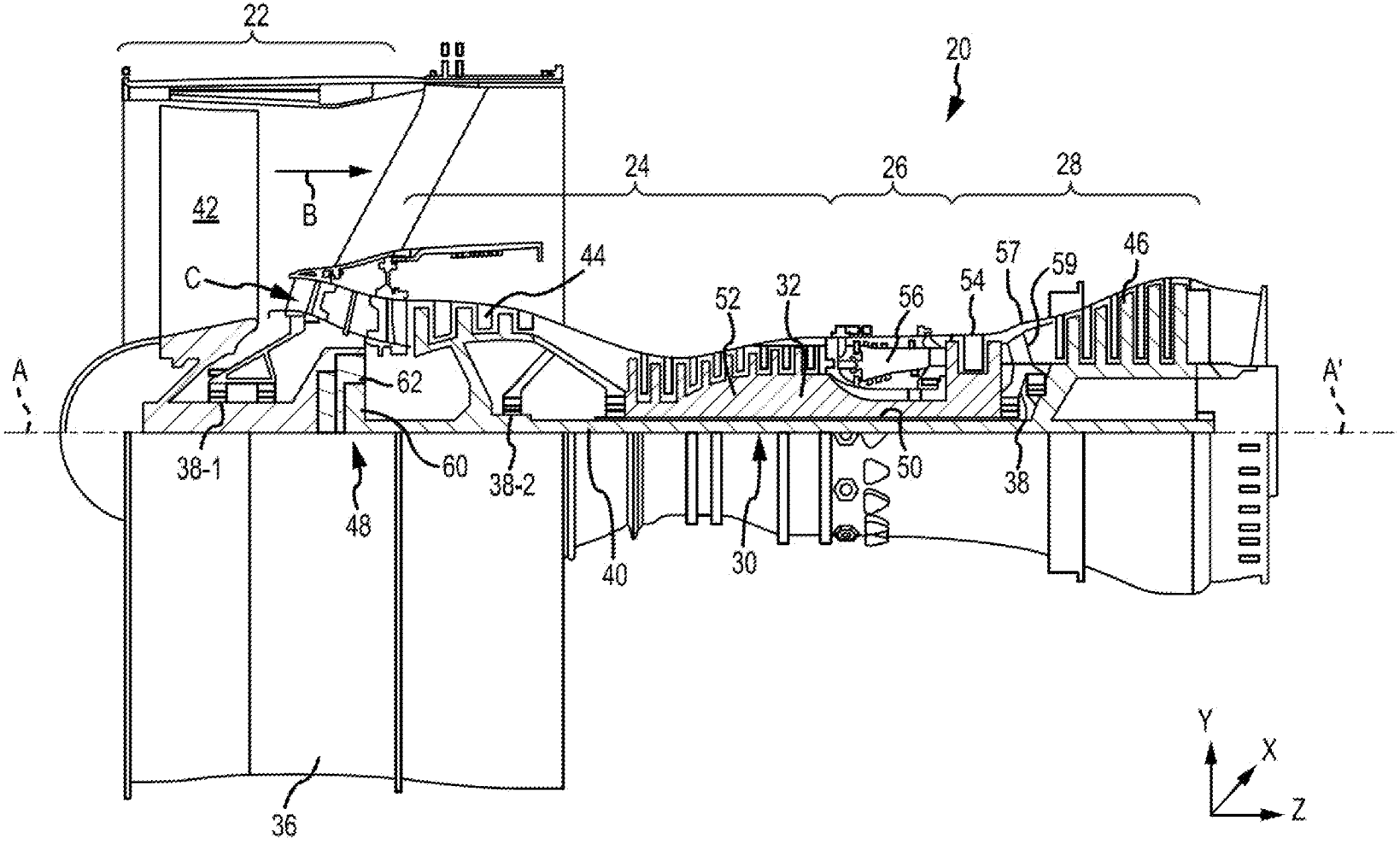
FIG. 1 is a cross-sectional view of an exemplary gas turbine engine, in accordance with various embodiments.

The subject matter of the present disclosure is particularly pointed out and distinctly claimed in the concluding portion of the specification. A more complete understanding of the present disclosure, however, may best be obtained by referring to the detailed description and claims when considered in connection with the drawing figures, wherein like numerals denote like elements.

DETAILED DESCRIPTION

The detailed description of exemplary embodiments herein makes reference to the accompanying drawings, which show exemplary embodiments by way of illustration. While these exemplary embodiments are described in sufficient detail to enable those skilled in the art to practice the disclosure, it should be understood that other embodiments may be realized and that logical changes and adaptations in design and construction may be made in accordance with this disclosure and the teachings herein without departing from the spirit and scope of the disclosure. Thus, the detailed description herein is presented for purposes of illustration only and not of limitation.

As used herein, "aft" refers to the direction associated with the exhaust (e.g., the back end) of a gas turbine engine. As used herein, "forward" refers to the direction associated with the intake (e.g., the front end) of a gas turbine engine. A first component that is "radially outward" of a second component means that the first component is positioned at a greater distance away from the engine central longitudinal axis than the second component. A first component that is "radially inward" of a second component means that the first component is positioned closer to the engine central longitudinal axis than the second component. In the case of components that rotate circumferentially about the engine central longitudinal axis, a first component that is radially inward of a second component rotates through a circumferentially shorter path than the second component. The terminology "radially outward" and "radially inward" may also be used relative to references other than the engine central longitudinal axis. For example, a first component of a combustor that is radially inward or radially outward of a second component of a combustor is positioned relative to the central longitudinal axis of the combustor. The term "axial," as used herein, refers to a direction along or parallel to the engine central longitudinal axis.

In various embodiments and with reference to FIG. 1, a gas turbine engine 20 is provided. Gas turbine engine 20 may be a two-spool turbofan that generally incorporates a fan section 22, a compressor section 24, a combustor section 26 and a turbine section 28. Alternative engines may include, for example, an augmentor section among other systems or features. In operation, fan section 22 can drive coolant (e.g., air) along a bypass flow-path B while compressor section 24 can drive coolant along a core flow-path C for compression and communication into combustor section 26 then expansion through turbine section 28. Although depicted as a turbofan gas turbine engine 20 herein, it should be understood that the concepts described herein are not limited to use with turbofans as the teachings may be applied to other types of turbine engines including three-spool architectures.

Gas turbine engine 20 may generally comprise a low speed spool 30 and a high speed spool 32 mounted for rotation about an engine central longitudinal axis A-A' relative to an engine static structure 36 or engine case via several bearing systems 38, 38-1, and 38-2. Engine central longitudinal axis A-A' is oriented in the z direction on the provided xyz axis. It should be understood that various bearing systems 38 at various locations may alternatively or additionally be provided, including for example, bearing system 38, bearing system 38-1, and bearing system 38-2.

Low speed spool 30 may generally comprise an inner shaft 40 that interconnects a fan 42, a low pressure compressor 44 and a low pressure turbine 46. Inner shaft 40 may be connected to fan 42 through a geared architecture 48 that can drive fan 42 at a lower speed than low speed spool 30. Geared architecture 48 may comprise a gear assembly 60 enclosed within a gear housing 62. Gear assembly 60 couples inner shaft 40 to a rotating fan structure. High speed spool 32 may comprise an outer shaft 50 that interconnects a high pressure compressor 52 and high pressure turbine 54.

A combustor 56 may be located between high pressure compressor 52 and high pressure turbine 54. The combustor section 26 may have an annular wall assembly having inner and outer shells that support respective inner and outer heat shielding liners. The heat shield liners may include a plurality of combustor panels that collectively define the annular combustion chamber of the combustor 56. An annular cooling cavity is defined between the respective shells and combustor panels for supplying cooling air. Impingement holes are located in the shell to supply the cooling air from an outer air plenum and into the annular cooling cavity.

A mid-turbine frame 57 of engine static structure 36 may be located generally between high pressure turbine 54 and low pressure turbine 46. Mid-turbine frame 57 may support one or more bearing systems 38 in turbine section 28. Inner shaft 40 and outer shaft 50 may be concentric and rotate via bearing systems 38 about the engine central longitudinal axis A-A', which is collinear with their longitudinal axes. As used herein, a "high pressure" compressor or turbine experiences a higher pressure than a corresponding "low pressure" compressor or turbine.

The core airflow C may be compressed by low pressure compressor 44 then high pressure compressor 52, mixed and burned with fuel in combustor 56, then expanded over high pressure turbine 54 and low pressure turbine 46. Turbines 46, 54 rotationally drive the respective low speed spool 30 and high speed spool 32 in response to the expansion.

In various embodiments, geared architecture 48 may be an epicyclic gear train, such as a star gear system (sun gear in meshing engagement with a plurality of star gears supported by a carrier and in meshing engagement with a ring gear) or other gear system. Geared architecture 48 may have a gear reduction ratio of greater than about 2.3 and low pressure turbine 46 may have a pressure ratio that is greater than about five (5). In various embodiments, the bypass ratio of gas turbine engine 20 is greater than about ten (10:1). In various embodiments, the diameter of fan 42 may be significantly larger than that of the low pressure compressor 44, and the low pressure turbine 46 may have a pressure ratio that is greater than about five (5:1). Low pressure turbine 46 pressure ratio may be measured prior to inlet of low pressure turbine 46 as related to the pressure at the outlet of low pressure turbine 46 prior to an exhaust nozzle. It should be understood, however, that the above parameters are exemplary of various embodiments of a suitable geared architecture engine and that the present disclosure contemplates other gas turbine engines including direct drive turbofans. A gas turbine engine may comprise an industrial gas turbine (IGT) or a geared aircraft engine, such as a geared turbofan, or non-geared aircraft engine, such as a turbofan, or may comprise any gas turbine engine as desired.

Figure 2:
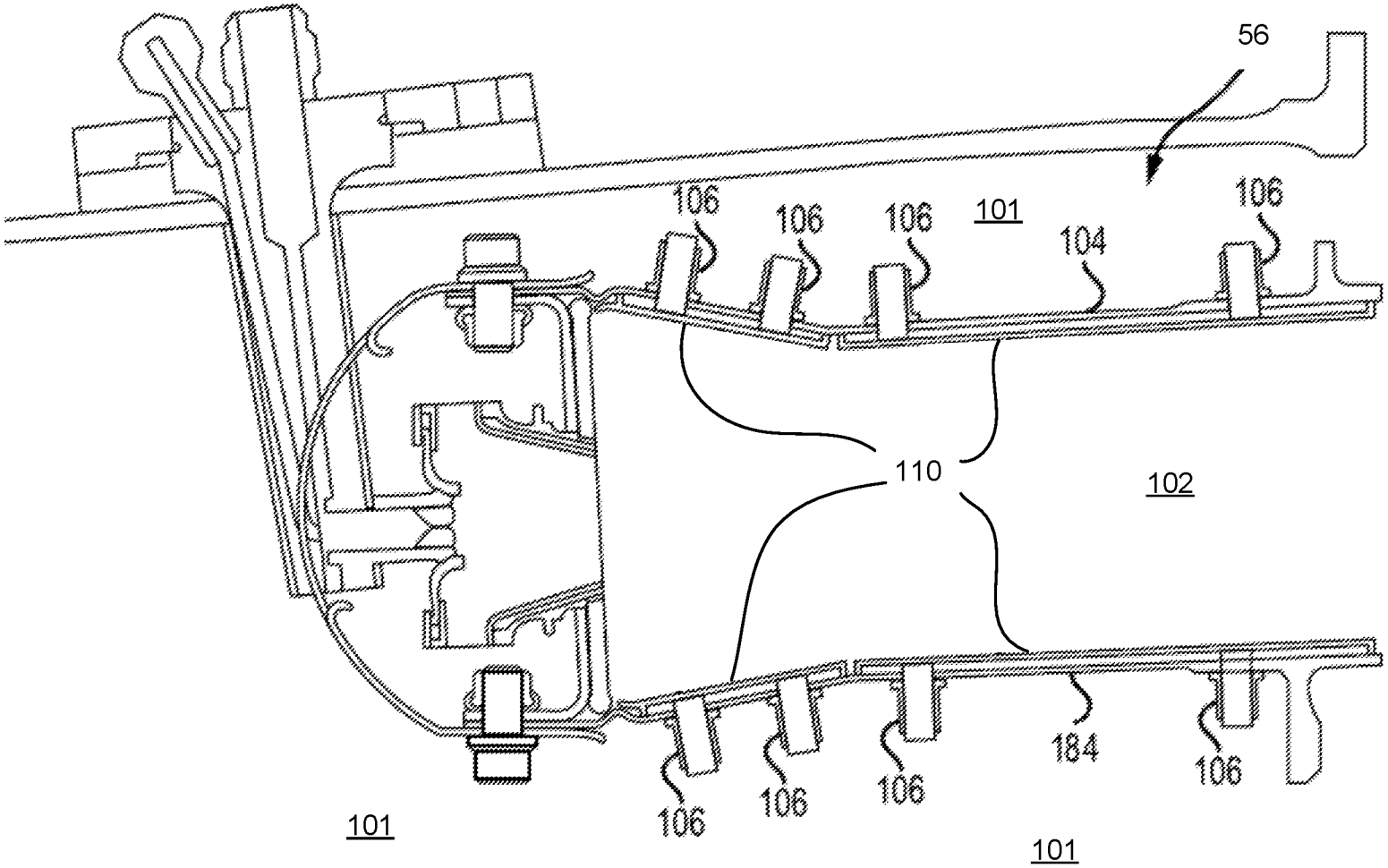
FIG. 2 is a cross-sectional view of a combustor of a gas turbine engine, in accordance with various embodiments.

With reference to FIG. 2, an in accordance with various embodiments, one or more combustor panels 110 (e.g., thermal shields, combustor liners) may be positioned in combustor 56 to protect various features of the combustor 56 from the high temperature flames and/or combustion gases. The combustor 56, in various embodiments, may have a combustor chamber 102 defined by a combustor outer shell 104 and a combustor inner shell 184. A diffuser chamber 101 is external the combustor 56 and cooling air may be configured to flow through the diffuser chamber 101 around the combustor 56. The combustor chamber 102 may form a region of mixing of core airflow C (with brief reference to FIG. 1) and fuel, and may direct the high-speed exhaust gases produced by the ignition of this mixture inside the combustor 56. The combustor outer shell 104 and the combustor inner shell 184 may provide structural support to the combustor 56 and its components. For example, a combustor outer shell 104 and a combustor inner shell 184 may comprise a substantially cylindrical or a substantially conical canister portion defining an inner area comprising the combustor chamber 102.

As mentioned above, it may be desirable to protect the combustor outer shell 104 and the combustor inner shell 184 from the harmful effects of high temperatures. Accordingly, one or more combustor panels 110 may be disposed inside the combustor chamber 102 and may provide such protection. The combustor panels 110 may comprise a partial cylindrical or conical surface section. An outer combustor thermal panel may be arranged radially inward of the combustor outer shell 104, for example, circumferentially about the inner surface of the combustor outer shell 104 and one or more inner combustor panels may also be arranged radially outward of the combustor inner shell 184. Thus, while the terms "radially outward" and "radially inward" are defined above as being relative to the engine central longitudinal axis A-A', the terms "outward" and "inward," without the modifier "radially," refer to positions relative to the combustor chamber 102. That is, the combustor shells 104, 184 are outward of the combustor panels 110, and vice versa. The combustor panels 110 may comprise a variety of materials, such as metal, metal alloys, and/or ceramic matrix composites, among others With continued reference to FIG. 2, the combustor panels 110 may be mounted and/or coupled to the combustor shell 104/184 via one or more attachment features 106. The combustor panels 110 may be made of any suitable heat tolerant material. In this manner, the combustor panels 110 may be substantially resistant to thermal mechanical fatigue in order to inhibit cracking of the combustor panels 110 and/or to inhibit liberation of portions of the combustor panels 110. In various embodiments, the combustor panels 110 may be made from a nickel based alloy and/or a cobalt based alloy, among others. For example, the combustor panels 110 may be made from a high performance nickel-based super alloy. In various embodiments, the combustor panels 110 may be made from a cobalt-nickel-chromium-tungsten alloy.

Figure 3:
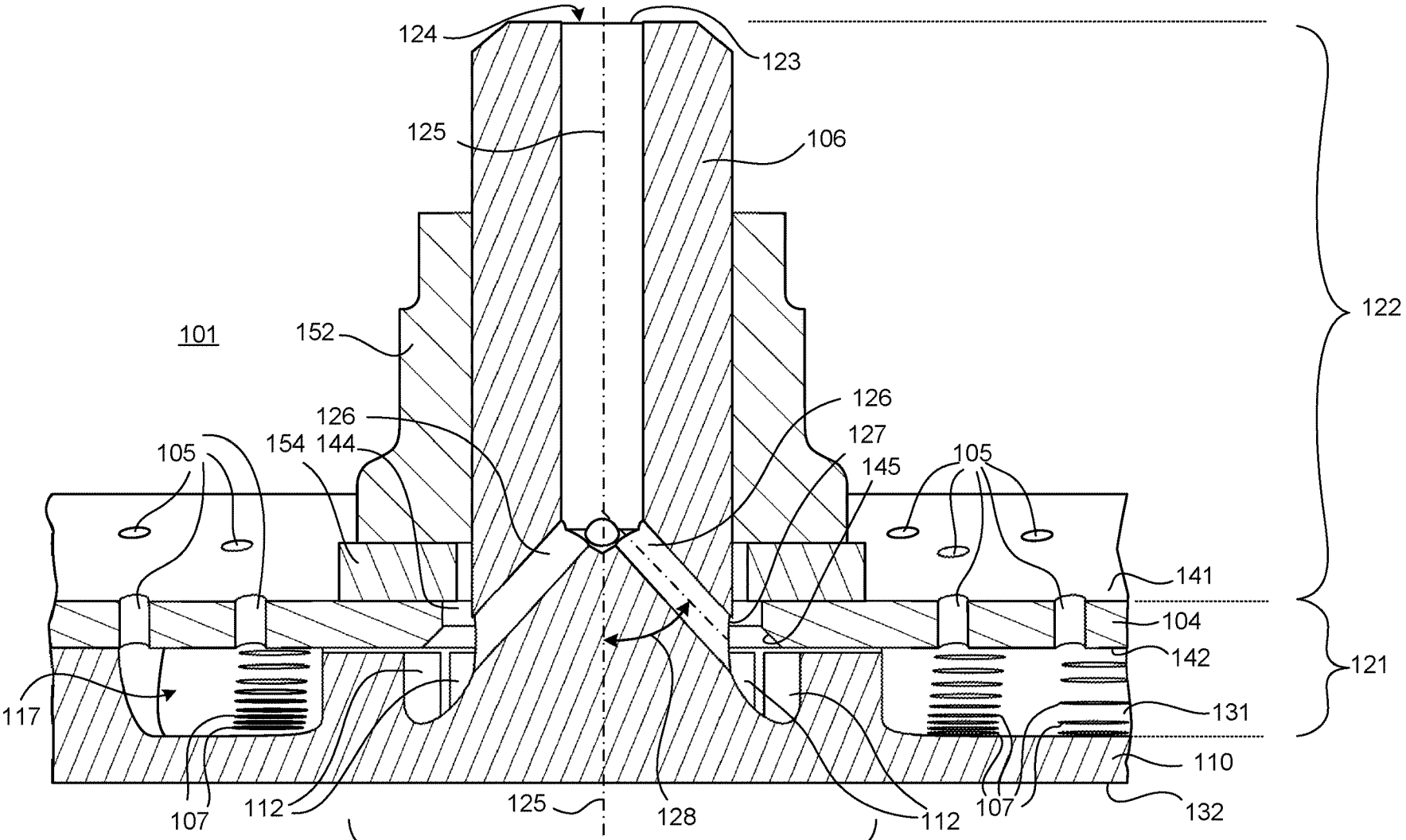
FIG. 3 is a perspective cross-sectional view of an attachment feature of a combustor panel extending through a combustor shell, in accordance with various embodiments.

In various embodiments, and with reference to FIG. 3, an annular cooling cavity 117 is formed and/or defined between the combustor shell 104 and the combustor panel 110. As mentioned above, cooling air in the diffuser chamber 101 may enter the annular cooling cavity 117 via impingement holes 105 formed in the combustor shell 104. That is, impingement holes 105 may extend from a diffuser-facing side 141 of the combustor shell 104 to a combustor-facing side 142 of the combustor shell 104 and may supply cooling air to the annular cooling cavity 117. The cooling air in the annular cooling cavity 117 may enter the combustor chamber 102 via effusion holes 107 formed in the combustor panel. That is, effusion holes 107 may extend from a cooling surface or "cold side" 131 of the combustor panel to a combustion facing surface or "hot side" 132 of the combustor panel that is opposite the cold side 131. In various embodiments, the effusion holes 107 are generally oriented to create a protective "blanket" of air film over the hot side 132 of the combustor panel thereby protecting the combustor panel from the hot combustion gases in the combustor chamber 102.

The one or more attachment features 106 facilitate coupling and/or mounting the combustor panels 110 to the respective shells 104, 184 of the combustor 56. In various embodiments, the attachment feature 106 may be a boss or a stud extending from the combustor panels 110, as described in greater detail below. The high operating temperatures and pressure ratios of the combustion gases in the combustor section 26 may create operating environments that can damage various components of the combustor. A conventional combustor may cause hotspots to form in the vicinity of the attachment features and thus potentially shortening the operational life of the combustor because such areas of the assembly are prone to oxidation (e.g., "burnthrough") of the combustor panel. In various embodiments, and with reference to both FIGS. 3 and 5, area 115 (which generally marks and refers to a region of the combustor panel, the combustor shell, and the volume therebetween), in a conventional combustor, may lack sufficient cooling airflow. This insufficient airflow in a conventional combustor is due in part because of the lack of effusion holes and/or impingement holes in area 115. It may be imprudent to have cooling holes in area 115 due to concerns regarding the structural integrity of the combustor panel if effusion holes are placed too close to the attachment feature, a projected footprint of which (i.e., projected attachment feature footprint 520) is shown in FIG. 5. Additionally, impingement holes may not be operative if positioned too close to the attachment feature, as the washer 154 (see also FIG. 4) would cover such impingement holes. Therefore, disclosed herein, according to various embodiments, is a cooling configuration for an attachment feature 106 that provides cooling airflow to the attachment feature 106 itself and cooling airflow to area 115.

In various embodiments, and with continued reference to FIG. 3, a combustor panel 110 having an attachment feature 106 extending therefrom is provided. The attachment feature 106, according to various embodiments, has a central longitudinal axis 125 and extends from the cold side 131 of the combustor panel 110. The attachment feature 106 may include a base portion 121 and a tip portion 122. The base portion 121 of the attachment feature 106 is generally defined, according to various embodiments, as the section of the attachment feature 106 disposed between the cold side 131 of the combustor panel 110 and the diffuser-facing side 141 of the combustor shell 140. The tip portion 122 of the attachment feature 106 is generally defined, according to various embodiments, as the section of the attachment feature 106 disposed outward of the diffuser-facing side 141 of the combustor shell 104. Once again, as established above, the terms "outward" and "inward," without the modifier "radially", refer to positions relative to the combustor chamber 102. That is, the combustor shell 104 is outward of the combustor panel 110.

In various embodiments, the attachment feature 106 defines a core passage 124 and one or more offshoot passages 126. The core passage 124 extends from an inlet opening 123 defined on the tip portion 122 of the attachment feature 106 and extends partially through a length of the attachment feature 106. That is, the core passage 124 terminates (i.e., has a closed, terminating end) within the attachment feature 106 and thus does not extend entirely through the attachment feature 106 or the combustor panel 110 to the combustor chamber 102. The closed end of the core passage 124 may be in the tip portion 122 or the base portion 121. The offshoot passage 126 extends from the core passage 124 to an outlet opening 127 defined on the base portion 121 of the attachment feature 106. Said differently, the outlet opening 127 of the offshoot passage 126 is defined on a circumference of the base portion 121 of the attachment feature and extends to intersect the core passage 124. Thus, the core passage 124 and the offshoot passage 126 collectively form a cooling airflow conduit from the diffuser chamber 101, through the tip portion 122 of the attachment feature 106, and into the annular cooling cavity 117. Accordingly, the core passage 124 and the offshoot passage 126 provide cooling airflow to the attachment feature 106 and provide impingement cooling to the cold side 131 of the combustor panel 110 in area 115.

In various embodiments, and with continued reference to FIG. 3, the core passage 124 extends parallel to the central longitudinal axis 125. In various embodiments, the core passage 124 is coaxial with the central longitudinal axis 125. In various embodiments, the offshoot passage(s) 124 may be circumferentially distributed around and may extend radially, relative to the central longitudinal axis 125 of the attachment feature 106, from the core passage 124. In various embodiments, the attachment feature 106 may define a plurality of offshoot passages 126. For example, the attachment feature 106 may define between 2 and 5 offshoot passages 126. In various embodiments, the attachment feature 106 defines 3 offshoot passages. In various embodiments, the attachment feature 106 defines 4 offshoot passages.

In various embodiments, an angle 128 between the central longitudinal axis 125 and each offshoot passage 126 is between about 15 degrees and about 85 degrees. As used in this context only, the term "about" refers to plus or minus 5 degrees. In various embodiments, the angle 128 is between about 30 degrees and about 60 degrees. In various embodiments, the angle 128 is about 45 degrees.

Figure 4:
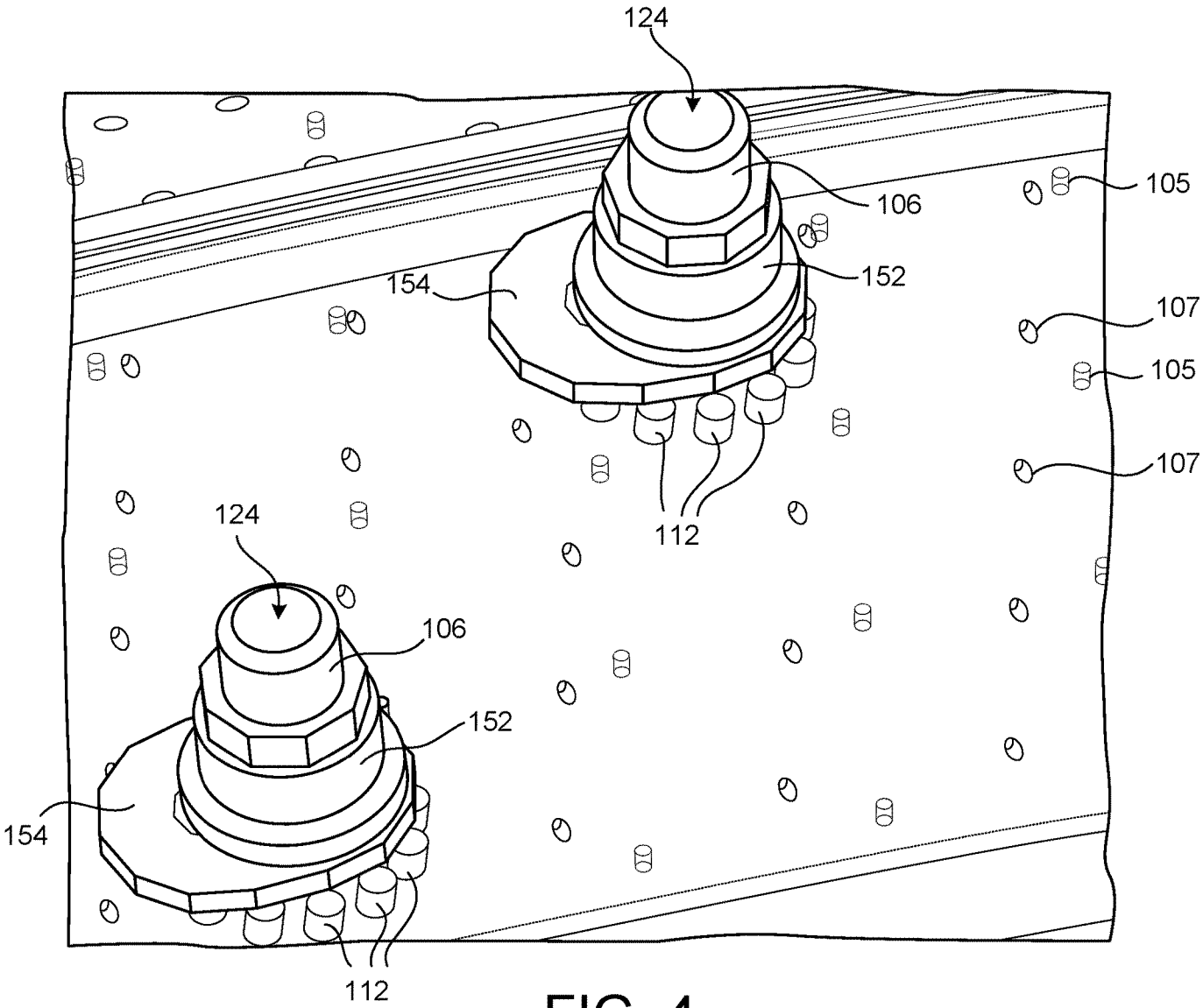
FIG. 4 is perspective view from outside a combustor chamber of an attachment feature of a combustor panel extending through a combustor shell, in accordance with various embodiments.
Figure 5:
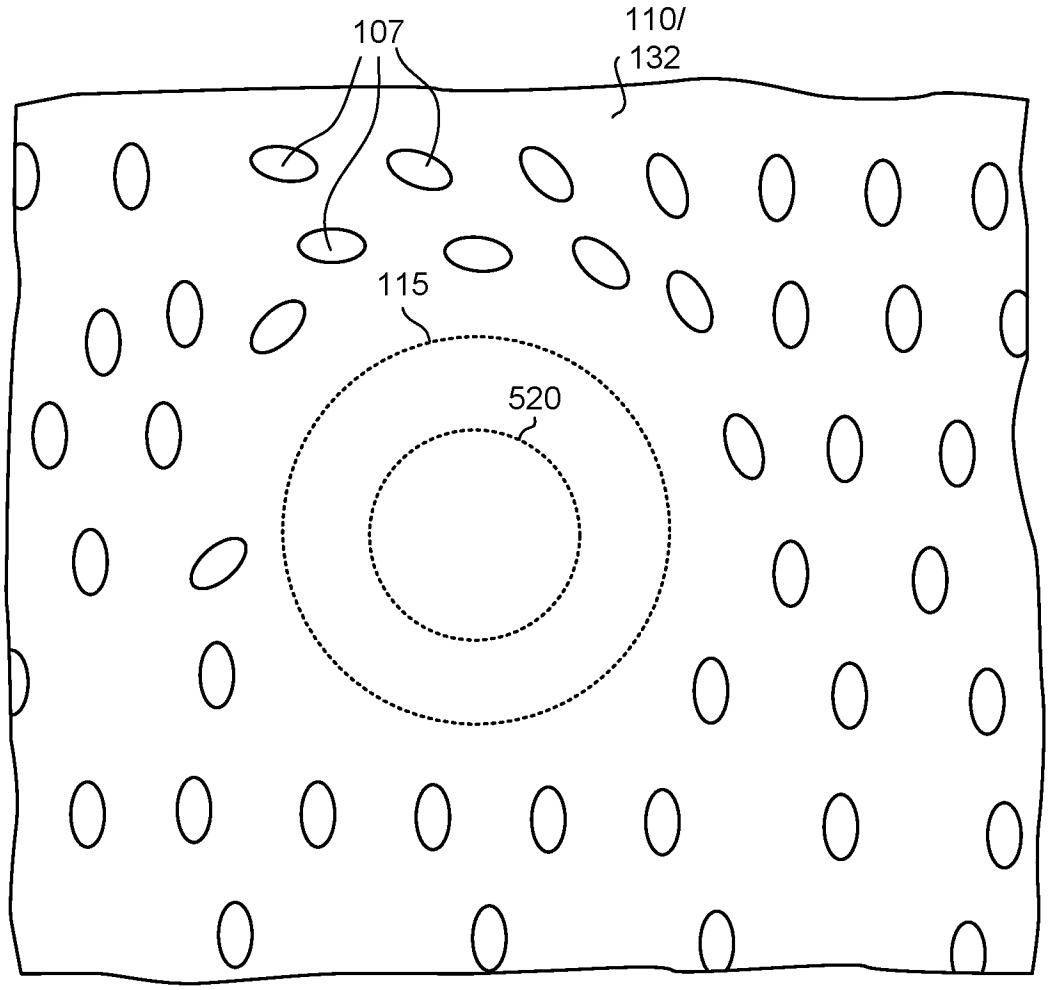
FIG. 5 is a view from within the combustor chamber of a combustor panel, in accordance with various embodiments.

In various embodiments, and with reference to FIGS. 3 and 4, the attachment feature 106 is a cylindrical boss, such as a pin with a threaded circumference, or may be a rectangular boss, such as for receiving a clip, or may be any other apparatus whereby the combustor panel 110 is mounted to the combustor shell 104. The attachment feature 106 may be integrally formed with the combustor panel 110. In various embodiments, the attachment feature 106 comprises a threaded stud that extends through hole 144 in the combustor shell 104. The attachment feature 106 may be retained in position by a nut 152 disposed outward of the combustor shell 104 and engaged onto the attachment feature and torqued so that the attachment feature 106 is preloaded with a retaining force and securely affixes the combustor panel 110 in a substantially fixed position relative to the combustor shell 104. In various embodiments, a washer 154 may be disposed between the nut 152 and the diffuser-facing side 141 of the combustor shell 104. In various embodiments, the hole 144 in the combustor shell 104 through which the attachment feature 106 extends may be oval, obround, or some other elongated shape (e.g., a slot) to provide clearance/tolerance during assembly/installation of the combustor panel 110. Accordingly, the washer 154 may have a corresponding elongated shape (FIG. 4).

In various embodiments, and with continued reference to FIGS. 3 and 4, the combustor panel 110 includes a plurality of standoffs 112 extending from the cold side 131 of the combustor panel 110 that are circumferentially distributed around the base portion 121 of the attachment feature 106. In various embodiments, the outlet opening 127 of the offshoot passage(s) 126 is configured to deliver impingement cooling air to an interconnected volume defined between the standoffs 112 and the attachment feature 106. That is, the offshoot passage(s) 126 are configured for delivering cooling airflow to the portion of the annular cooling cavity 117 adjacent the attachment feature 106. In various embodiments, the outlet opening 127 of the offshoot passage(s) 126 is disposed inward of the washer 154. In various embodiments, the outlet opening 127 is at least partially disposed within the hole 144 defined in the combustor shell 104. In such embodiments, the hole 144 may have a chamfered inward edge 145 or a filleted inward edge. The chamfered or filleted inward edge 145 of the hole 144 may facilitate the flow of cooling airflow exiting the outlet opening 127 (i.e., may prevent the combustor shell 104 from obstructing all or a portion of the outlet opening 127). In various embodiments, the outlet opening 127 is disposed inward of the combustor-facing side 142 of the combustor shell 104.

Figure 6:
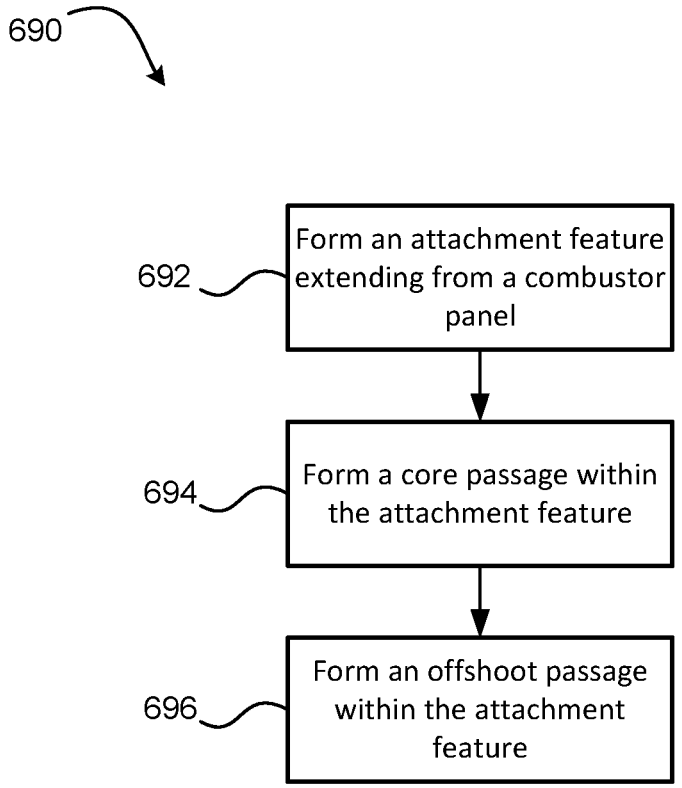
FIG. 6 is a schematic flow chart diagram of a method of manufacturing a combustor panel, in accordance with various embodiments.

In various embodiments, and with reference to FIG. 6, a method 690 of manufacturing the combustor panel 110 is provided. The method 690 may include forming the attachment feature 106 extending from the combustor panel 110 at step 692, forming the core passage 124 within the attachment feature 106 at step 694, and forming at least one offshoot passage 126 within the attachment feature 106 at step 696. The method 690 may be performed using various manufacturing techniques. In various embodiments, at least steps 694 and 696 may be performed by electrical discharge machining (EDM), additive manufacturing, or casting using one or more cores, among others.

Benefits, other advantages, and solutions to problems have been described herein with regard to specific embodiments. Furthermore, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements of the disclosure.

The scope of the disclosure is accordingly to be limited by nothing other than the appended claims, in which reference to an element in the singular is not intended to mean "one and only one" unless explicitly so stated, but rather "one or more." It is to be understood that unless specifically stated otherwise, references to "a," "an," and/or "the" may include one or more than one and that reference to an item in the singular may also include the item in the plural. All ranges and ratio limits disclosed herein may be combined.

Moreover, where a phrase similar to "at least one of A, B, and C" is used in the claims, it is intended that the phrase be interpreted to mean that A alone may be present in an embodiment, B alone may be present in an embodiment, C alone may be present in an embodiment, or that any combination of the elements A, B and C may be present in a single embodiment; for example, A and B, A and C, B and C, or A and B and C. Different cross-hatching is used throughout the figures to denote different parts but not necessarily to denote the same or different materials.

The steps recited in any of the method or process descriptions may be executed in any order and are not necessarily limited to the order presented. Furthermore, any reference to singular includes plural embodiments, and any reference to more than one component or step may include a singular embodiment or step. Elements and steps in the figures are illustrated for simplicity and clarity and have not necessarily been rendered according to any particular sequence. For example, steps that may be performed concurrently or in different order are illustrated in the figures to help to improve understanding of embodiments of the present disclosure.

Any reference to attached, fixed, connected or the like may include permanent, removable, temporary, partial, full and/or any other possible attachment option. Additionally, any reference to without contact (or similar phrases) may also include reduced contact or minimal contact. Surface shading lines may be used throughout the figures to denote different parts or areas but not necessarily to denote the same or different materials. In some cases, reference coordinates may be specific to each figure.

Systems, methods and apparatus are provided herein. In the detailed description herein, references to "one embodiment," "an embodiment," "various embodiments," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element is intended to invoke 35 U.S.C. 112(f) unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus.

What is claimed is:

1. A combustor panel comprising a cold side and a hot side, wherein an outward direction is defined as a direction extending from the hot side to the cold side, the combustor panel comprising:

an attachment feature having a central longitudinal axis and extending from the cold side of the combustor panel, the attachment feature comprising a tip portion, a base portion, wherein the attachment feature is configured to extend through a combustor shell such that the tip portion is disposed outward of a diffuser-facing side of the combustor shell, and the base portion is configured to be disposed between the cold side of the combustor panel and the diffuser-facing side of the combustor shell a core passage extending from an inlet opening defined on the tip portion and extending coaxially along the central longitudinal axis and partially through the attachment feature to terminate within the attachment feature at a terminating end disposed outward of the combustor shell, and an offshoot passage extending from the terminating end to an outlet opening defined on the base portion, wherein the outlet opening is outward of the cold side of the combustor panel and is thus configured to provide impingement cooling to the cold side of the combustor panel.

2. The combustor panel of claim 1, wherein the attachment feature is integrally formed with the combustor panel.

3. The combustor panel of claim 1, wherein the offshoot passage is one offshoot passage of a plurality of offshoot passages.

4. The combustor panel of claim 3, wherein the plurality of offshoot passages are circumferentially distributed and extend radially, relative to the central longitudinal axis of the attachment feature, from the core passage.

5. The combustor panel of claim 4, wherein the plurality of offshoot passages comprises a first offshoot passage, a second offshoot passage and a third offshoot passage.

6. The combustor panel of claim 4, wherein the plurality of offshoot passages comprises a first offshoot passage, a second offshoot passage, a third offshoot passage, and a fourth offshoot passage.

7. The combustor panel of claim 4, wherein an angle between the central longitudinal axis and each offshoot passage of the plurality of offshoot passages is between about 15 degrees and about 85 degrees.

8. The combustor panel of claim 7, wherein the angle is between about 30 degrees and about 60 degrees.

9. The combustor panel of claim 8, wherein the angle is about 45 degrees.

10. A gas turbine engine comprising a combustor shell comprising a diffuser-facing side and a combustor-facing side;

a combustor panel comprising a cold side and a hot side, wherein an outward direction is defined as a direction extending from the hot side to the cold side and the combustor panel coupled to the combustor shell via an attachment feature integrally formed with and extending from the cold side of the combustor panel, the attachment feature having a central longitudinal axis and extending through a hole in the combustor shell; and an annular cooling cavity defined between the combustor shell and the combustor panel, wherein a cooling airflow conduit extends through the attachment feature and comprises an inlet opening for receiving cooling air from a diffuser chamber that is at least partially defined by the diffuser-facing side of the combustor shell, an outlet opening located outward of the cold side of the combustor panel for delivering the cooling air to the annular cooling cavity adjacent the attachment feature;

a core passage extending from the inlet opening coaxially along the central longitudinal axis through at least a portion of the attachment feature to terminate within the attachment feature at a terminating end disposed outward of the combustor shell, and an offshoot passage extending from the terminating end to the outlet opening.

11. The gas turbine engine of claim 10, wherein a tip portion of the attachment feature is disposed outward of the hole in the combustor shell and a base portion of the attachment feature is disposed between the cold side of the combustor panel and the diffuser-facing side of the combustor shell.

12. The gas turbine engine of claim 11, wherein the tip portion of the attachment feature comprises a threaded circumference for engaging a nut, wherein a washer is disposed between the nut and the diffuser-facing side of the combustor shell.

13. The gas turbine engine of claim 12, wherein the outlet opening of the offshoot passage lies on a plane parallel to the central longitudinal axis.

14. The gas turbine engine of claim 11, wherein the outlet opening of the offshoot passage is at least partially disposed within the hole in the combustor shell.

15. The gas turbine engine of claim 14, wherein the hole in the combustor shell comprises a chamfered inward edge or a filleted inward edge.

16. The gas turbine engine of claim 11, wherein the combustor panel comprises a plurality of standoffs extending from the cold side of the combustor panel and circumferentially disposed around the base portion of the attachment feature, wherein the outlet opening of the offshoot passage is configured to deliver impingement cooling air to an interconnected volume defined between the standoffs and the attachment feature.

* * * * *